US005772535A

United States Patent [19]

Murphy

[11] Patent Number: 5,772,535

[45] Date of Patent: Jun. 30, 1998

[54] INFLATABLE PORTABLE GAME

[76] Inventor: John Kenneth Murphy, 27 Gowan Lane, Aurora, Ontario, Canada, L4G 4X6

[21] Appl. No.: 768,936

[22] Filed: Dec. 18, 1996

[30] Foreign Application Priority Data

Nov. 19, 1996 [CA] Canada ..... 2190695

[51] Int. Cl.[6] ..... A63B 71/02

[52] U.S. Cl. ..... 473/415; 52/2.18; 273/349; 273/350; 472/128; 472/134; 473/466

[58] Field of Search ..... 473/415, 466; 273/349, 350, 457, 458; 472/134, 128; 441/40, 41; 52/2.18

[56] References Cited

U.S. PATENT DOCUMENTS

| | | | |
|---|---|---|---|
| 268,057 | 11/1882 | Townsend . | |
| 842,096 | 1/1907 | Hughes . | |
| 886,861 | 5/1908 | Randall . | |
| 1,082,699 | 12/1913 | Maynard . | |
| 2,443,440 | 6/1948 | Alvarez | 52/2.18 X |
| 2,940,214 | 6/1960 | Blanton et al. | 46/91 |
| 3,038,725 | 6/1962 | Stewart et al. | 273/119 |
| 3,066,937 | 12/1962 | Pflugmann | 273/85 |
| 3,122,368 | 2/1964 | Roy et al. | 273/121 |
| 3,136,548 | 6/1964 | Engle | 273/123 |
| 3,176,982 | 4/1965 | O'Daniell | 272/1 |
| 3,771,789 | 11/1973 | Kammerl | 273/85 |
| 3,808,831 | 5/1974 | Landry | 441/40 X |
| 4,014,543 | 3/1977 | Arad | 273/85 |
| 4,077,629 | 3/1978 | Chestney | 273/349 |
| 4,468,029 | 8/1984 | Kulesza et al. | 273/108 |
| 4,605,230 | 8/1986 | Halford et al. | 273/129 |
| 4,651,360 | 3/1987 | Wang | 52/2.18 X |
| 5,135,440 | 8/1992 | Smollar et al. | 472/128 |
| 5,288,071 | 2/1994 | Solomon | 273/85 |
| 5,462,505 | 10/1995 | Blair et al. | 482/27 |

*Primary Examiner*—William H. Grieb
*Attorney, Agent, or Firm*—Marcelo K. Sarkis; Neil H. Hughes; Ivor M. Hughes

[57] ABSTRACT

An inflatable portable substantially collapsible structure comprising an inflatable substantially collapsible playing field having at least two walls, a top and a bottom, at least one object director to direct an object with a fluid along or above the playing surface and at least one score area.

20 Claims, 11 Drawing Sheets

INFLATABLE PORTABLE GAME

TITLE OF INVENTION

1. Field of Invention

This invention relates to an inflatable, portable and substantially collapsible structure for use as an amusement attraction simulating a game played on a playing surface (field).

2. Background of the Invention

It is well known in the prior art to provide table and/or miniature games which simulate games played on playing fields, such as baseball, soccer, football, etc. U.S. Pat. No. 3,771,789 discloses:

"A table football apparatus comprises a playing surface over which the ball is moved by blasts of compressed air from nozzles arranged at the edges of the playing surface. Each nozzle can be in the form of a pistol-grip with a trigger, and is pivotal so as to sweep over the playing surface. Each trigger can be part of an electrical circuit for controlling the supply of compressed air to move the ball. The table football is a hollow sphere with apertured shell."

U.S. Pat. No. 4,014,543 discloses:

"An indoor game comparable in objective to the sport of soccer. A ball or other playing piece is propelled by air streams discharged from opposed nozzles horizontally from above each goal, the latter being in the form of a recess on a game table top. The nozzles are swiveled so that each air stream may be played horizontally across the entire top surface of the table. A plurality of freely rotatable vertical baffles is disposed on the upper surface of the table top to provide air-spinnable ball obstacles, comparable to real life soccer players, that, on occasion, trap the playing piece and thereafter fling the piece across the table top in a semi-predictable, semi-random course."

U.S. Pat. No. 4,468,024 discloses:

"A portable pneumatic action game for two opposing players has a base including a central raised hollow core supporting a playing surface and oppositely extending end sills. The playing surface has an array of separate elongated channels, each with an aperture at each end. A transparent cover extends over all of the channels.

Slots in the cover permit insertion of a playing piece into each channel. Slidably mounted on each of the sills is a manual air pump and nozzle which can be moved by the player along one end of the channel array to selectively register the nozzle in pneumatic communication with the aperture of one channel to propel the playing piece toward the opposite end. An opening is provided in the bottom of each channel adjacent each end for the playing piece to drop down into the hollow central core for later tallying of the respective players'scores."

U.S. Pat. No. 5,462,505 discloses:

"An inflatable structure having a trampoline-type floor with an inflatable framework projecting upwardly therefrom and having netting panels extending between adjacent portions of said framework to prevent a child from inadvertently bouncing out of the structure, with at least one of said panels having releasable fastening means to allow opening of said one of said panels as a door."

U.S. Pat. No. 5,135,440 discloses:

"A child's water toy comprises a pool which has inflatable (with either air or water) sides with a floor extending between them. One or a number of applique accessories may be heat sealed to the bottom or the sides of the pool. Exemplary of these applique accessories are slides, floating animal figurines, and the like. Bobbing accessories are counter-balanced accessories which may either float upright to be a playmate for the child or bob over to become a float on which the child may ride. The bobbing toy may have articulated joints which make it appear to change its shape depending upon whether it is standing upright or lying down. Still other accessories are scenery in the nature of trees, islands, vines, or the like, which may shower or drip water. These accessories may be assembled in different ways to provide play groupings."

Nowhere within the prior art, is there shown, as far as Applicant is aware, an inflatable portable structure which simulates not only a playing surface (field) (where the playing surface (field) is also inflatable) but where said inflatable structure includes at least one nozzle which provides air to direct a playing piece such as a ball along or above the playing surface to simulate a game. Accordingly, it is an object of the present invention to provide an inflatable portable structure which simulates a game played on a playing surface (field). It is still another object of the invention to provide an inflatable portable structure which is substantially collapsible and which has at least one nozzle providing air to the playing surface (field) in order to move a playing piece (i.e. ball or puck) along or over the playing surface (field). It is still another object of the invention to provide a method of simulating a game played on a playing surface (field). It is yet another object of the invention to provide the use of an inflatable portable structure for simulating a game played on a playing surface (field). It is another object of the present invention to provide a novel indoor and/or outdoor inflatable game which offers the players amusement, challenge and also promotes physical activity. It is another object of the present invention to provide an indoor and/or outdoor inflatable game which simulates in objective and configuration games such as hockey, football, soccer, baseball, golf, bowling and other games which involve the use of an object moved along a playing surface (field), and where there is defined a score area. It is yet another object of the present invention to provide a novel inflatable game which is substantially portable. It is yet another object of the present invention to provide a novel inflatable game which is substantially collapsible. It is yet another object of the present invention to provide a novel inflatable game which is facile to operate and transport. It is yet another object of the invention to provide a novel inflatable game which can be played indoors, outdoors, on a table top, or in a park. It is yet another object of the invention to provide a novel inflatable game which may be of various sizes to suit the areas where the game is to be played. Further and other objects of this invention will become apparent to a person skilled in the art from the following summary of the invention and a more detailed description of the preferred embodiments illustrated herein.

SUMMARY OF THE INVENTION

According to one aspect of the invention, there is provide an inflatable portable structure, preferably substantially collapsible when not inflated, comprising an inflatable playing field being inflatable between two conditions, a first fully deflated and storable condition and a second fully functioning fully inflated condition, having at least two sides, a top and a bottom, at least one nozzle extending from said playing field and providing a fluid, preferably air or water, in the general direction of the playing field, said nozzle for moving an object which can be moved by said air provided by said at least one nozzle and at least one score area. In a preferred embodiment one end of said at least one nozzle is preferably movable. In another embodiment said inflatable portable structure, preferably substantially collapsible, when deflated, further comprises an aperture disposed on said inflatable structure at a predetermined position for connection of a fluid supplier to said inflatable structure. In yet another embodiment said fluid supplier also provides fluid to at least one nozzle. Yet another embodiment said inflatable, portable structure, preferably substantially collapsible, further comprises at least one restrainer to minimize movement of said inflatable portable structure. Said restrainer preferably is integral with said inflatable portable structure. In yet another embodiment there is provided for use in amusing and promoting physical activity an inflatable portable structure, preferably substantially collapsible, comprising at least one restrainer to minimize movement of said inflatable portable structure, preferably substantially collapsible. In yet another embodiment there is provided a method of simulating a game said method comprising the use of an inflatable portable structure preferably substantially collapsible.

According to another aspect of the invention, there is provided an inflatable game structure comprising:

an inflatable playing field having at least two walls (sides), a top and a bottom, preferably said top and bottom are connected by a plurality of substantially vertical baffles, at least one fluid supply element, preferably air, to direct an object, and at least one score area.

Preferably said inflatable structure is kept inflated by an air blower. Preferably said air blower is attached to said inflatable structure by an air blower aperture situated at a predetermined position, preferably a position which does not interfere with the playing of the game. In a preferred embodiment the air blower provides air to said inflatable playing field and to said at least one fluid supply element.

In one embodiment, said playing field, the top thereof preferably include game indicia based on the game being played. For hockey, the game indicia would include a center face-off area, four end zone face-off areas, a center line, three blue-lines. Similarly for other games such as football, soccer, baseball, bowling, golf and other games, the game indicia would be appropriate to the game chosen.

In another embodiment, said inflatable playing field further comprises at least one, preferably inflatable, obstacle to add to the excitement of the game, by having the object or playing piece make contact with the obstacle this adding another degree of excitement to the game.

In yet another embodiment, said obstacle is generally in the shape of a typical player of the game being played, i.e. hockey player, baseball player, bowler, golfer or the like dependent on the game being played. Preferably there may be a plurality of obstacles at predetermined locations dependent on the game being played.

In a preferred embodiment, the playing field comprises a plurality of air supply elements, preferably air hoses, preferably situated at a predetermined location to simulate the game being played, i.e. for hockey, for one half of the playing surface two air hoses as forwards proximate a goal area, one air hose as defense proximate a goal area, one air hose as goal keeper proximate a goal area. The other half would be exact in air hose number and the other goal area would have a goal keeper as well. Preferably, dependent on the game being simulated, there are one or more players, in a preferred embodiment there are 6–8 players.

In one embodiment, proximate the goal area, the goal keeper would be an elongated substantially movable foam member not provided with air supply. This embodiment adds another degree of difficulty to the game played.

In another preferred embodiment, the inflatable game structure comprises two side walls, two end walls, a top and a bottom;

a plurality of air hoses, preferably movable, integral with said side walls, providing a stream of air along said top;

a playing piece movable along or above said top, by said stream of air;

a plurality of obstacles, preferably inflatable, preferably in the shape of players of the game at a predetermined position proximate said top;

at least one score area, preferably two, proximate one of said two end walls, preferably a score area at each of said two end walls, at least one goal keeper proximate said at least one score area, preferably a goal keeper proximate each of said two score areas, preferably said goal keeper is a foam baton.

In yet another embodiment, the inflatable game structure is substantially collapsible and substantially portable when collapsed.

In yet another embodiment, said inflatable game structure further comprises a scoring device to aid in keeping the score throughout the game.

In yet another embodiment, said two side walls and said two end walls are substantially higher than said top, thus aiding to keep the object within the playing field, dependent on the game being played.

In yet another embodiment, said goal area is preferably recessed outwardly from said end wall, to further define the goal area in the event of a scoring situation.

In an alternative embodiment, there is provided a method of amusing and promoting physical activity, comprising participating in a simulated game played on an inflatable portable structure, said structure comprising, an inflatable substantially collapsible playing surface having at least two
walls, a top and a bottom, at least one object director to direct an object with fluid along or above the
playing surface and at least one score area, wherein said method comprises the steps of:

(1) inflating said inflatable structure, (2) at least one player directing said object with said object director along or above the playing surface to at least one score area.

In an alternative embodiment, there is provided an inflatable game structure comprises two side walls, two end walls, a top and a bottom;

a plurality of substantially movable air hoses, integral with said side walls, providing a stream of air along said top;

a playing piece movable along or above said top, by said stream of air;

a plurality of substantially inflatable obstacles, substantially in the shape of players of the game at predetermined positions proximate said top;

at least two score areas, each score area proximate each of said two end walls, a goal keeper proximate each of said two score areas.

In an alternative embodiment, there is provided a game for amusement and promotion of physical activity comprising the use of an inflatable portable playing field comprising:

an inflatable unit substantially collapsible and portable when not in use having a top, a bottom and at least two sides said top further comprises a playing field at least one fluid nozzle to direct an object along or above the playing field, and at least one score area, wherein said game comprises at least one object movable to said at least one score area, at least one player moving said game piece to said at least one score area with said at least one fluid nozzle.

BRIEF DESCRIPTION OF THE DRAWINGS

The invention will now be illustrated with respect to the following drawings illustrating embodiments of the invention in which:

Referring now to FIG. 1, the portable inflatable game 1 is kept inflated by a blower 1A (see FIG. 6). In this embodiment there is shown a simulated hockey game. A playing surface 2 has a series of obstacles 3 at predetermined locations on said surface 2 to increase the excitement of the game since the playing piece, in this instance the ball (puck) 4 (see FIG. 3), may strike an obstacle 3 and the player may then need to modify the strategy. Each obstacle 3 is a hollow cylinder shape with one open end 3A and one closed end 3B. Said open end 3A attached to an obstacle aperture 2A on the playing surface 2, such that the air from the blower 1A keeps each obstacle 3 upright since the hollow cylinder shape is filled with the air from the blower 1A. Along the perimeter of the playing surface 1 are two air-filled hollow sidewalls 5, 5' and two air-filled hollow end walls 6, 6', with the air coming from the blower 1A, enough to keep the walls upright. These walls 5, 5', 6, 6' aid in keeping the ball (puck) 4 in the playing surface 2 throughout the game. At each end wall 6, 6' is located a goal area 7 which is recessed to simulate a goal or net substantially normal from the playing surface 2. This serves to provide a clear indication of when a player scores with the ball (puck) 4 throughout the game. Along the top of each end wall 6, 6' there is provided a net 8 to aid in keeping the ball (puck) 4 within the playing surface 2 and to help define the goal area 7.

Protruding from the sidewalls 5, 5' are a plurality of substantially flexible air hoses 9 of a predetermined length which not only provide a stream of air to move the ball (puck) 4 along or above the playing surface 2, but also aid in regulating the air pressure within the game 1 so as to prevent the game 1 from over-inflation. One end 9A is attached to a hose aperture on the sidewall The stream of air is provided by the same blower 1A which keeps the game 1 inflated. In this embodiment on one sidewall 5 there are four flexible air hoses 9A, 9A', 9B, 9B', 9A, 9A' for one team or player and 9B, 9B' for another team or player. They may be colour coded to indicate team sides. Similarly, sidewall 5' includes two flexible air hoses 9B", 9A" such that air hose 9B" is across from and on the same playing side as air hose 9A, 9A', and similarly air hose 9A" is across from and on the same playing side as air hoses 9B, 9B'. At each end wall 6, 6', preferably near the rear of the goal area 7, there is a flexible air hose 7B, 7A to aid the player at the goal area 7 to defend the goal area 7 from the ball (puck) 4 from entering the goal area 7. In FIG. 10 the air hose 7B, 7A is substituted with a movable foam baton.

Figure 3:
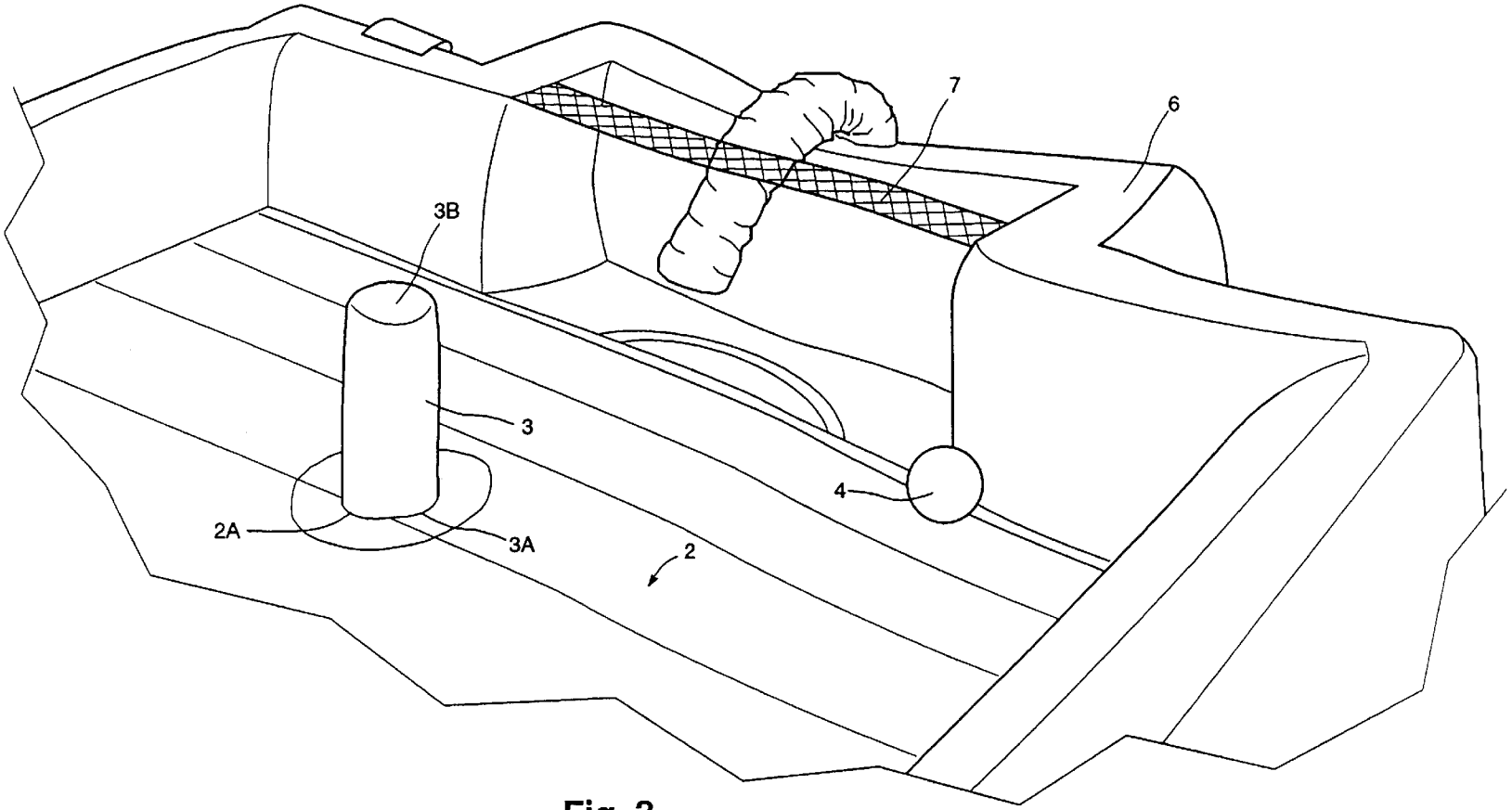
FIG. 3 is an enlarged view of the goal area of FIG. 1.

In this configuration, the players'surface 2 is divided into two equal sides to suit the game being simulated, in this instance hockey. Each side includes a goal area 7, configured in a box-like manner as best seen in FIG. 3.

As per the above, one side includes two defense air hoses 7A, 9A" and two offense air hoses 9B, 9B', and similarly the other side includes two defence air hoses 7B, 9B" and two offense air hoses 9A, 9A'. In this manner, there are an equal number of offenses and defenses throughout the game, a first player would hold an air hose and direct the ball (puck) 4 along the surface with the air from the air hose avoiding the obstacles and a second player, to place the ball (puck) in the second player's goal area. Should there be a penalty or the like, an air hose could easily be disabled by laying the air hose over the side or by capping the air hose to disable it or any other suitable manner.

Figure 4:
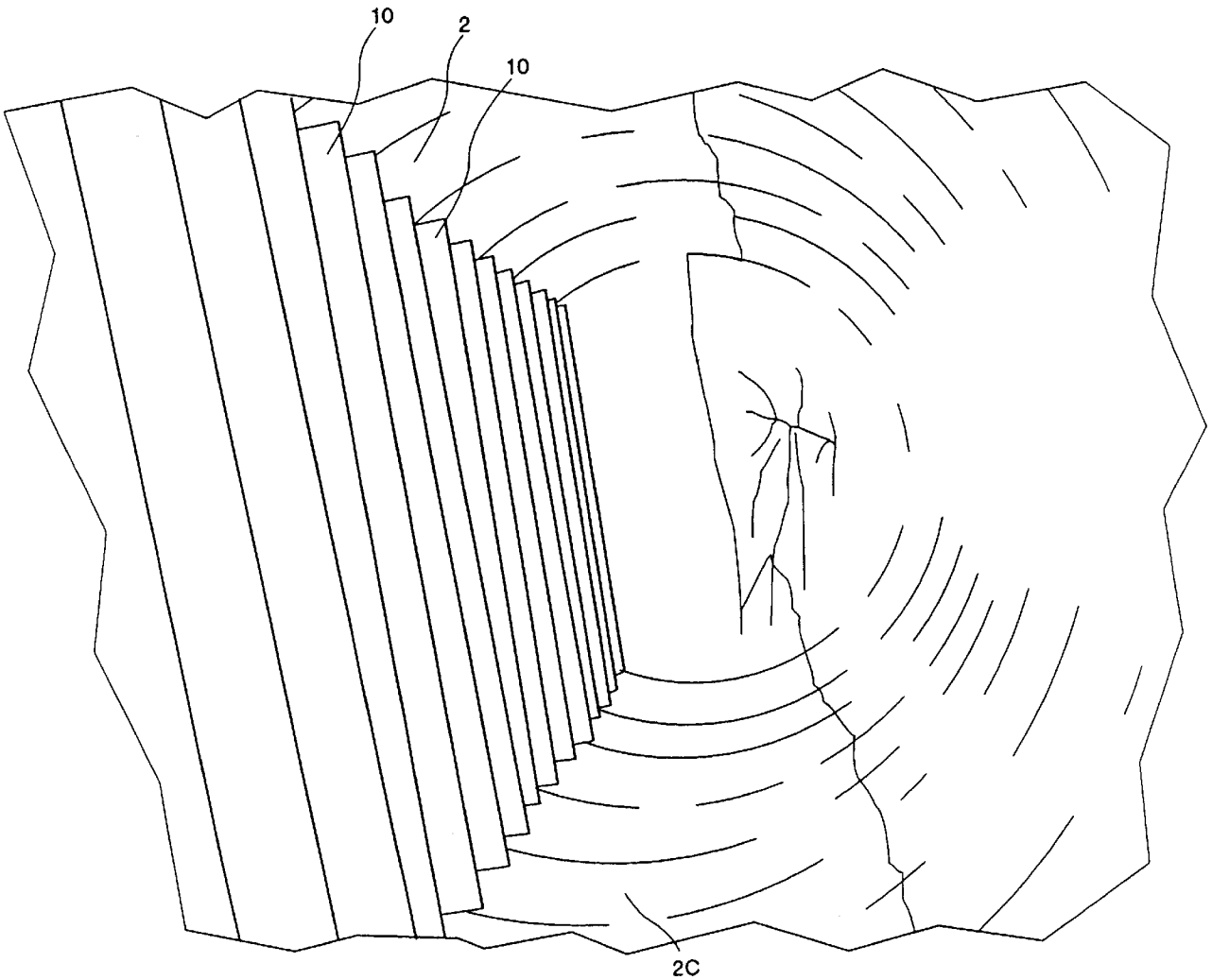
FIG. 4 is a sectional view of the inside of the invention depicting the baffles taken along the length of the invention.
Figure 5:
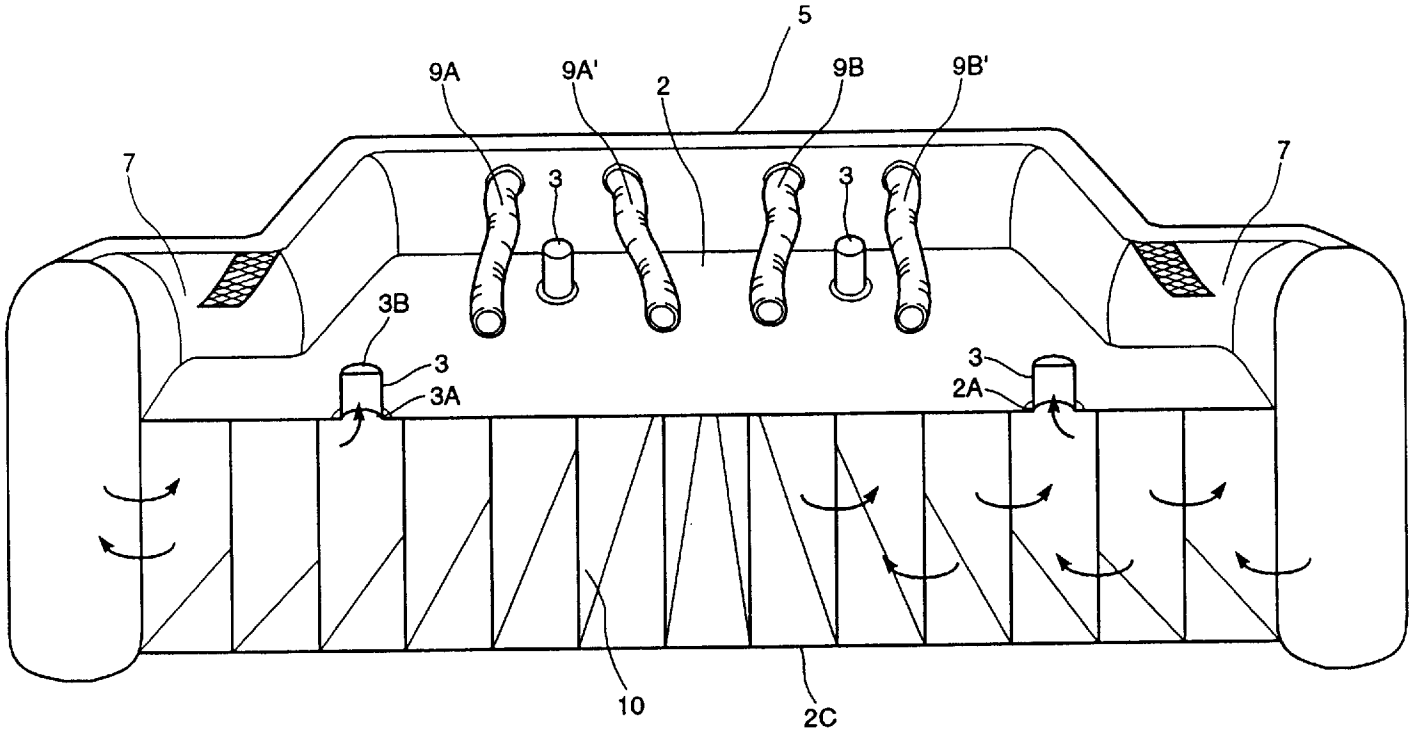
FIG. 5 is a sectional view of the inside of the invention taken along lines the length of FIG. 1.
Figure 6:
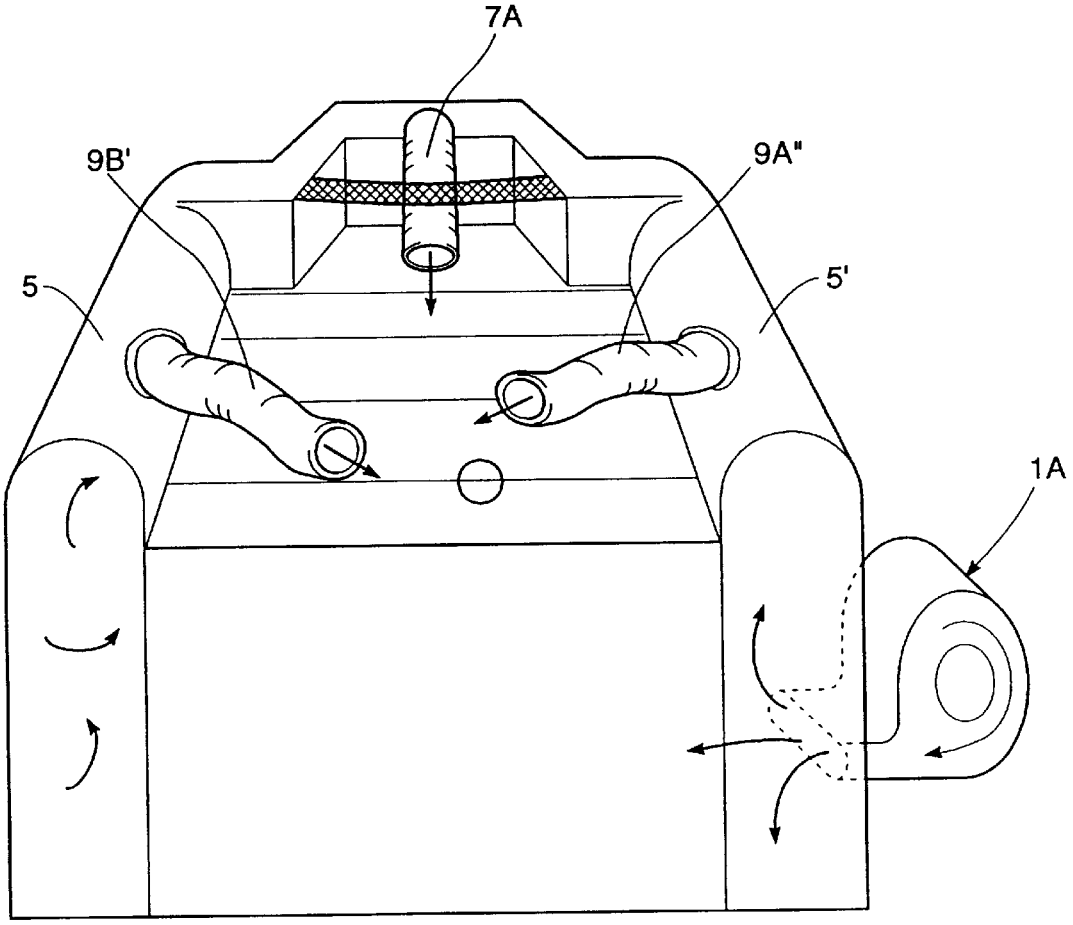
FIG. 6 is a sectional view of the inside of the invention taken along the width of FIG. 1.

The playing surface 2 is kept stable by a series of baffles 10 running substantially vertically between the playing surface 2 and the bottom 2C, located in the interior of the game 1, as best seen in FIG. 4 and 5. The number of baffles and the distance between each are dependent on the size of the game 1. In this instance, the game is 10' long×5' wide×2'6" tall. In this instance there are 29 baffles spaced 6" apart. Applicant has found this configuration to be advantageous for this size game. Depending on the location in which the game is to be played, the dimensions may be varied to accommodate the area, such as a den in a home, a park, a table top, etc.

Figure 1:
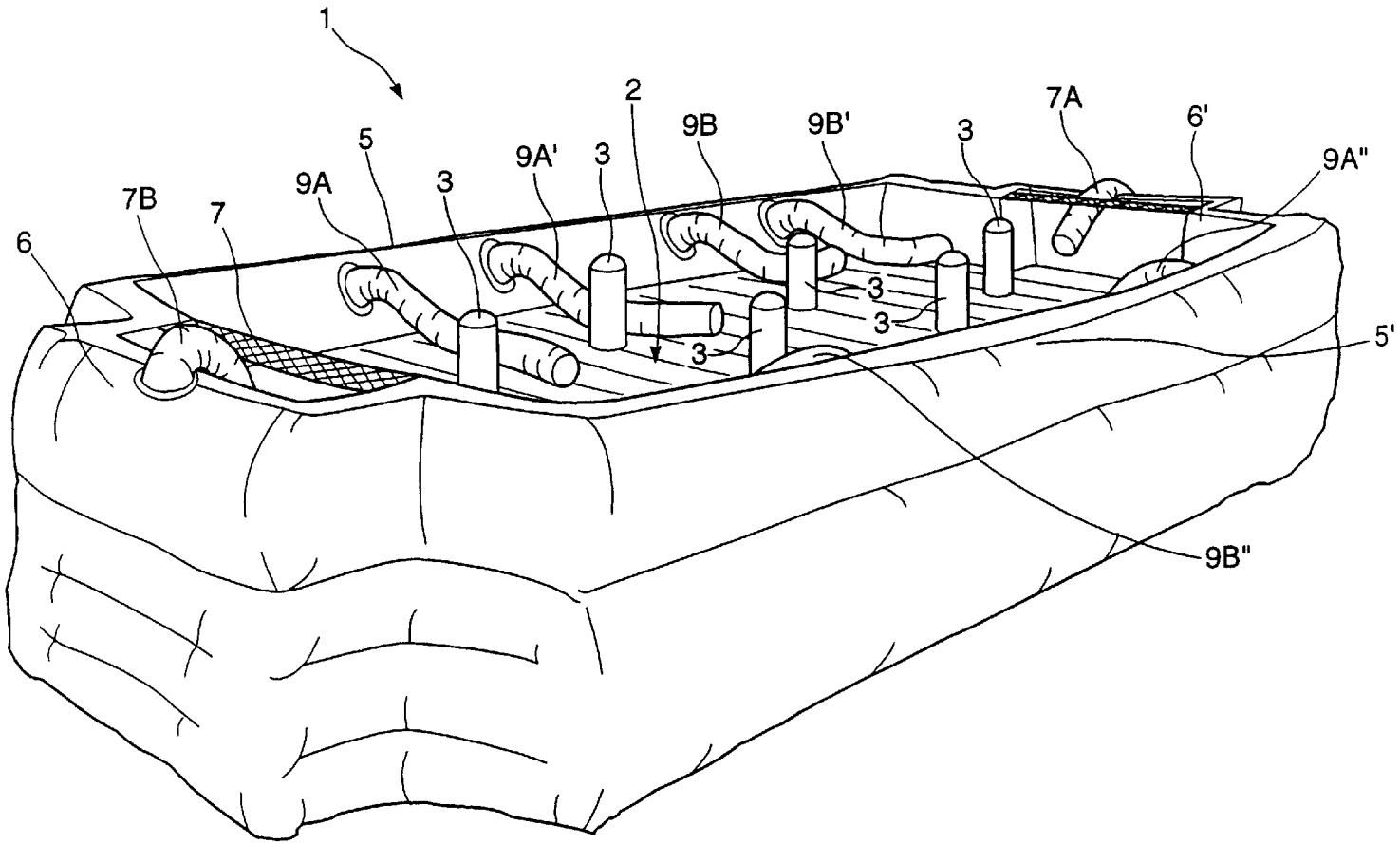
FIG. 1 is an overall perspective view of the invention in one embodiment when inflated.
Figure 2:
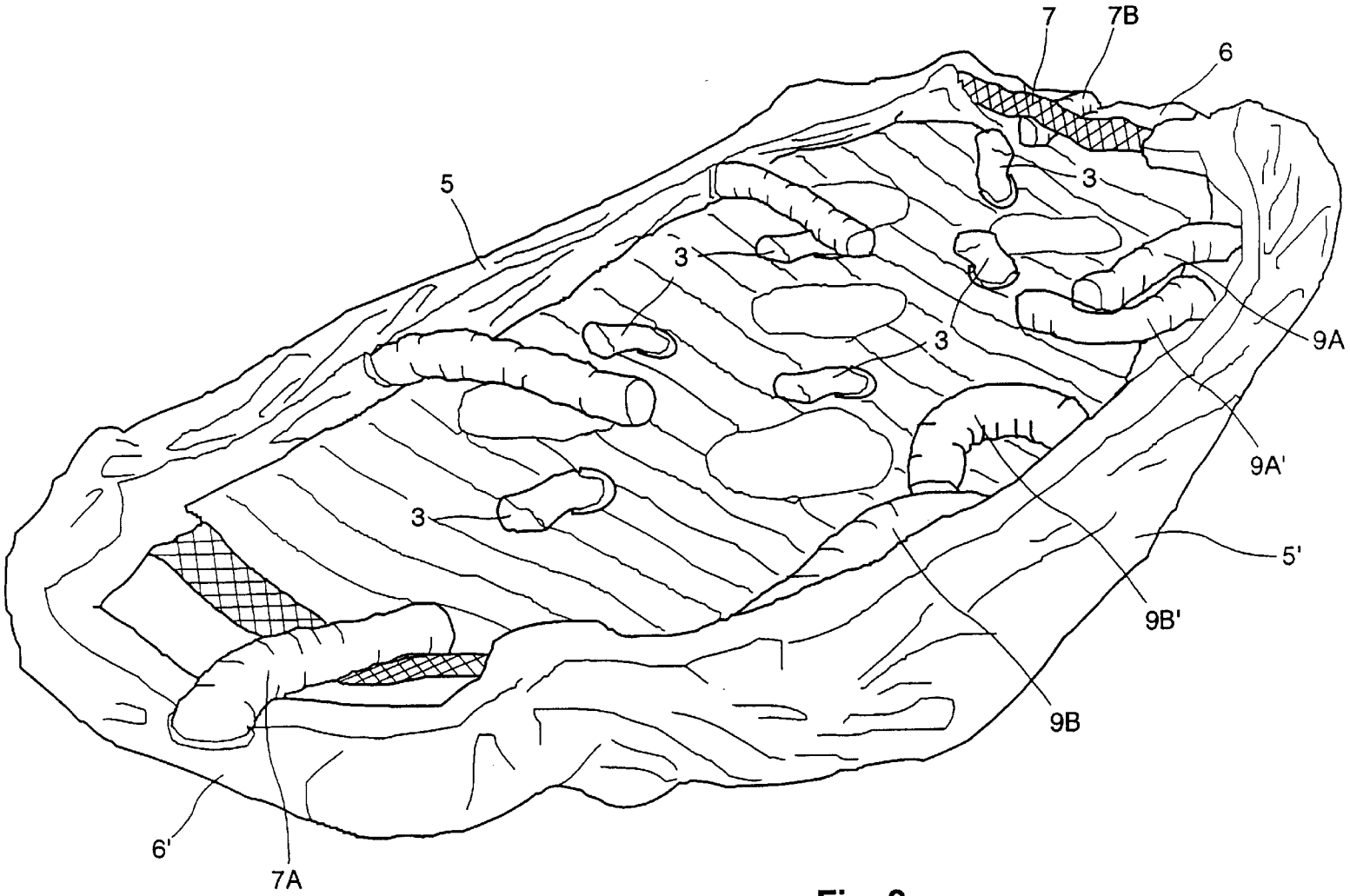
FIG. 2 is an overall perspective view of the invention of FIG. 1 when deflated.

As can be seen in FIG. 1 and FIG. 2, the playing surface has indicia appropriate to the game being simulated. In this instance, the game being simulated is hockey, and the indicia include a center face-off area, and two end zone face off areas for each side. Furthermore, the obstacles are situated such that they also aid in defending the goal area. The blower specifications are dependent on the size of the game. In this instance the blower used is a domestic carpet blower producing up to 3500 cubic feet per minute air movement. Furthermore, the blower 1A is attached to the game 1 by a blower aperture located at a predetermined position on the game 1.

The material preferred for the game is nylon, preferably 210 denier nylon, where the sidewalls, the end walls, the top and bottom are attached preferably by a lap seam stitch pattern using an appropriate thread such as a CSB-69 polynylon thread. The colors may resemble colors of various teams in various sports. The sidewalls could also include team logos or advertisements.

Figure 7:
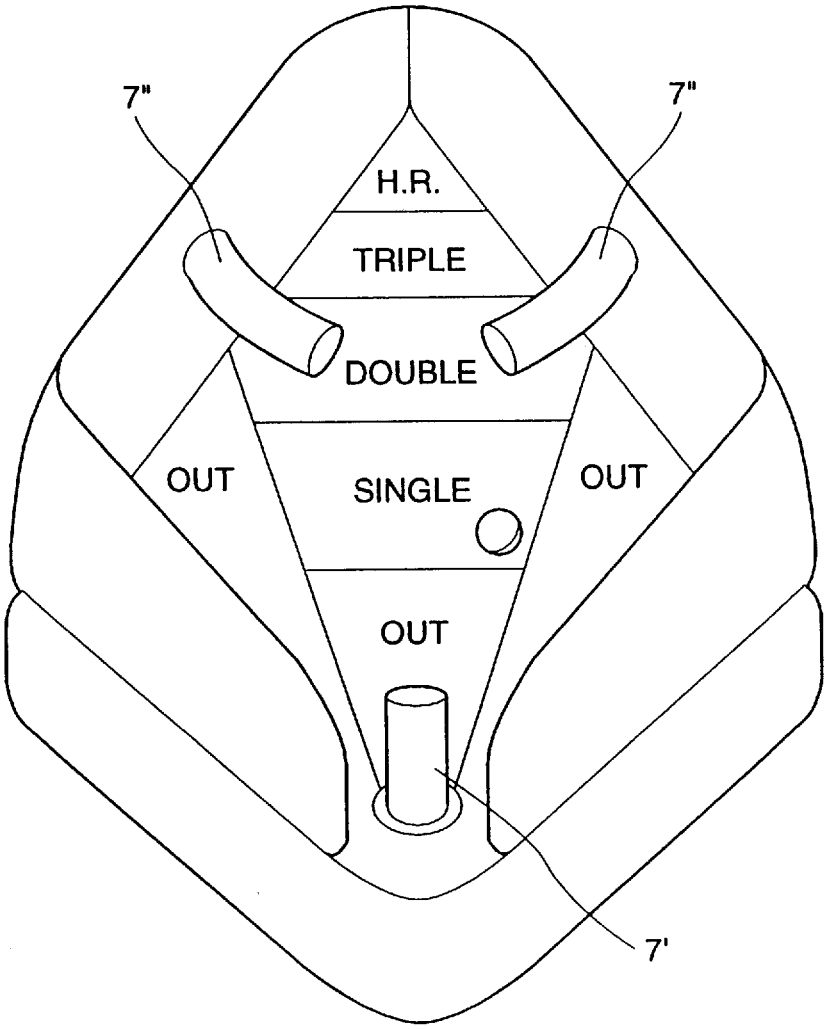
FIG. 7 is a perspective view of the invention in another embodiment simulating a baseball game.

In another embodiment, the portable inflatable game simulates baseball as per FIG. 7 where there is a playing surface and a single hose at one end, the home plate and two hoses at each field. The indicia on the playing surface includes scoring zones such as single, double, triple and home run, as well as out zones. The first player would direct the ball in the air with the single hose to a score zone and the defender would attempt to direct the ball back to the out zone with the two defending air hoses. Once the ball lands on the surface the defender would not be able to direct the ball and the score to the player would depend on where the ball landed.

Figure 8:
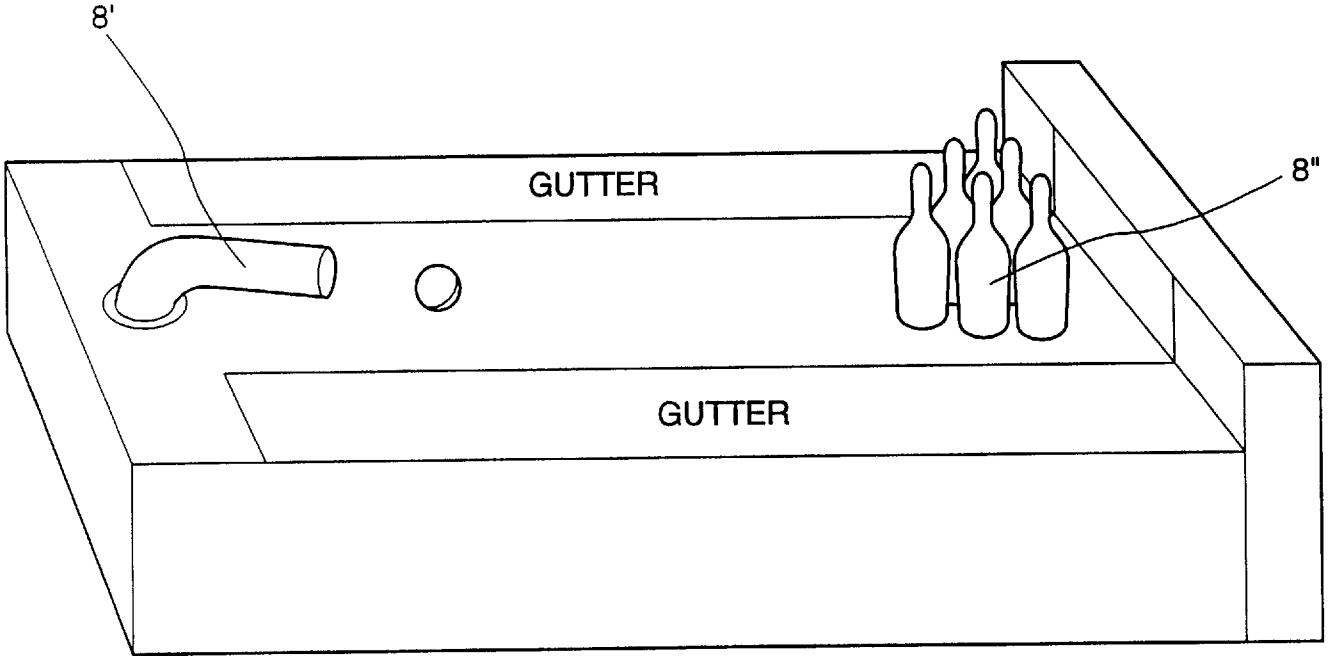
FIG. 8 is a perspective view of the invention in another embodiment simulating a bowling game.

FIG. 8 illustrates an embodiment where the playing surface simulates a bowling alley. In this instance the goal area includes simulated bowling pins and at the other end there is an air hose which can direct a simulated bowling ball. The sides may include a "gutter" zone. The player would, in this instance, direct the ball along the playing surface with the air hose to attempt to knock down as many pins as possible in the score area while avoiding having the ball land in the gutter zone.

In all instances the hoses may be collapsible and/or detachable for portability.

In all instances, the playing piece may be of a solid or hollow material. A solid material may include a foamed material. A hollow material may be a table tennis ball, but we have found that a foam ball is preferred. The playing piece also may be a shape to suit the particular game being played, i.e. ball, puck-shaped, football shaped or whatever shape is desired for the game being simulated.

In most instances it will be preferable to provide curved corners where the side walls and end walls meet to avoid the game piece from being lodged in the corner, stopping or delaying playing of the game.

Figure 9:
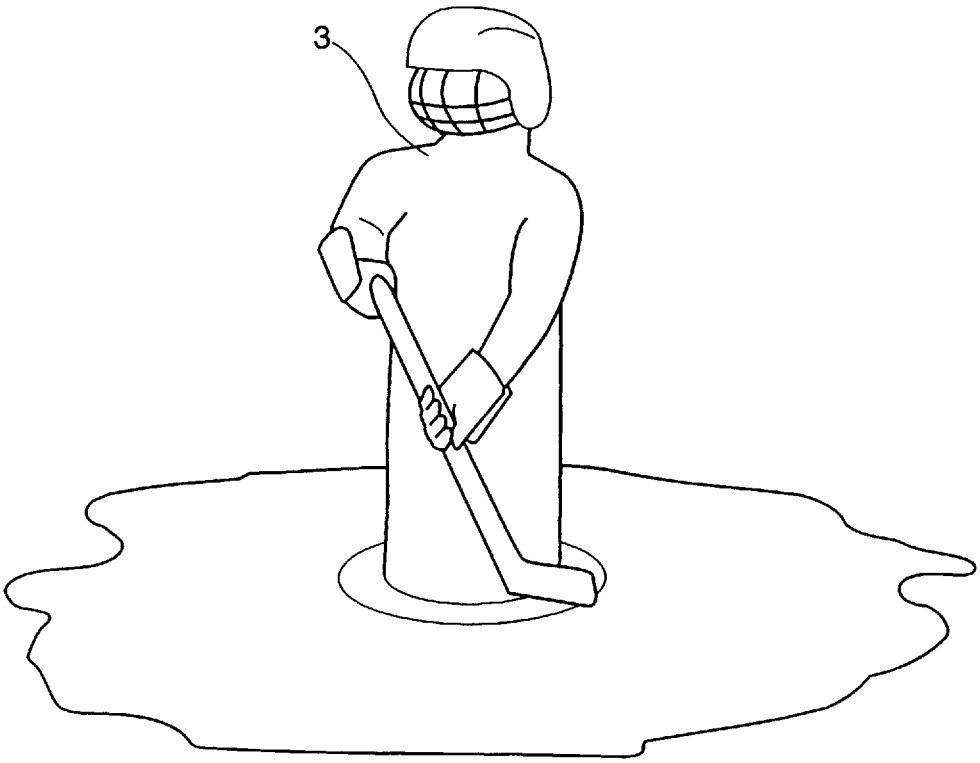
FIG. 9 is a perspective view of the inflatable obstacle in the general shape of a player.

Although the obstacles are shown as hollow cylinders in this instance, they may also resemble players of the particular game being played (i.e. hockey players, soccer players, etc., as seen in FIG. 9).

Figure 10:
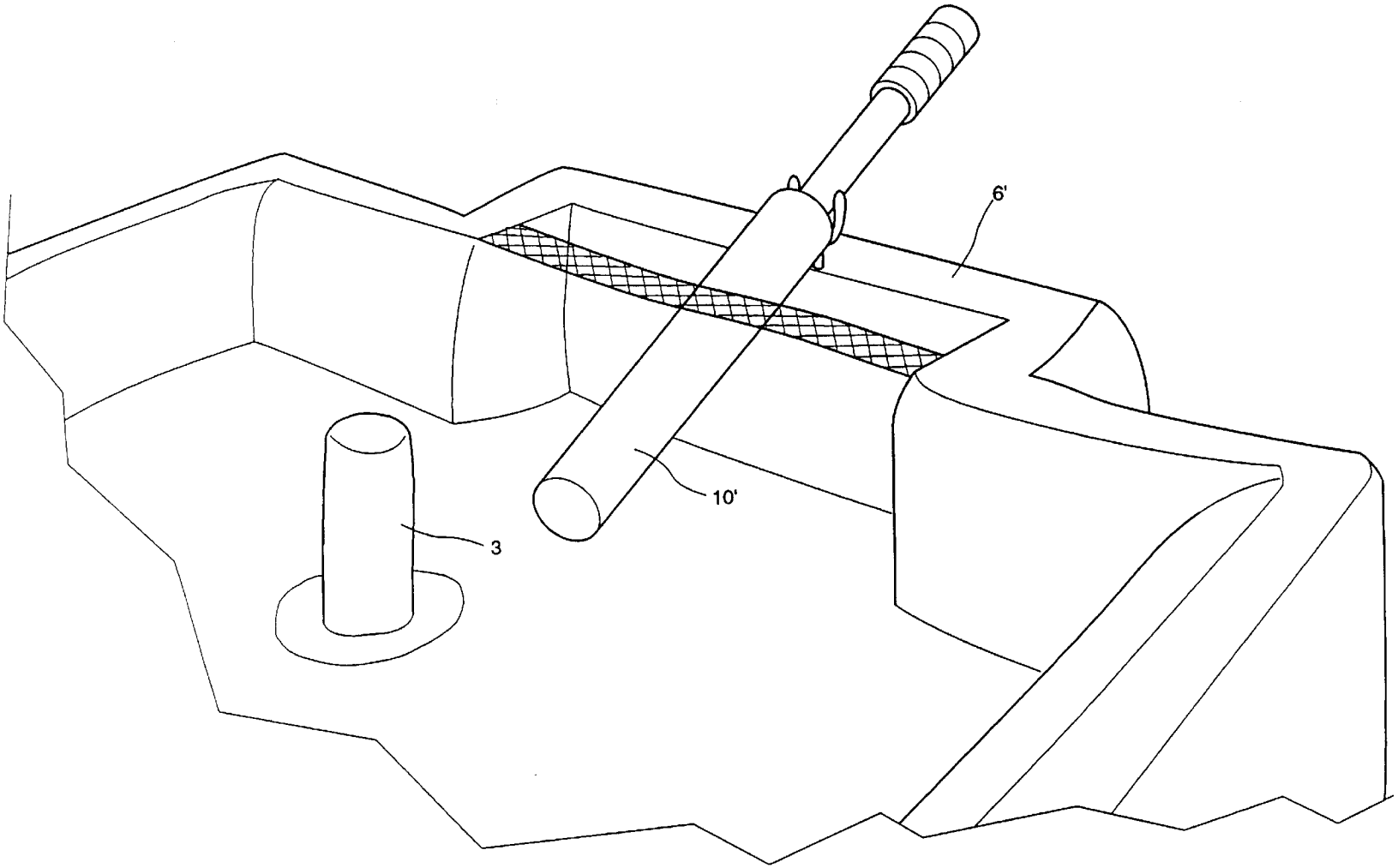
FIG. 10 is an enlarged view of the goal area in another embodiment where the goal keeper is a foam baton.

In FIG. 10, another embodiment is shown where the air hose for the goal area is replaced with a substantially foam baton. In this instance, the player would be able to strike the playing piece or ball in order to keep it out of the goal area. In all instances, a score is gained when the object reaches the goal area by having a player move the object with the object director along or above the playing surface without any infractions of the game rules dependent on the game being simulated.

Figure 11:
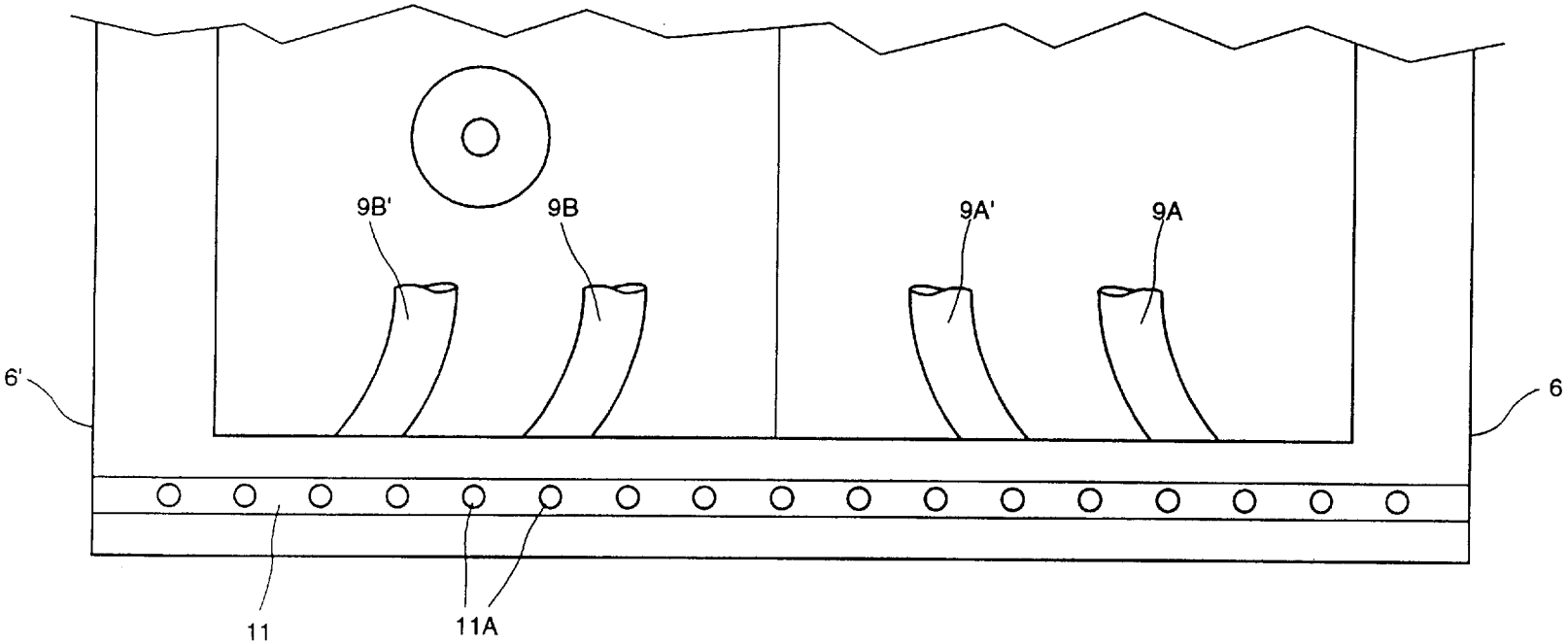
FIG. 11 is a sectional view of the side wall in an embodiment of the invention.

Referring now to FIG. 11, there is shown a substantially horizontal baffle 11 running along the side wall 5. The baffle 11 includes apertures 11A to allow air flow to the nozzles. The horizontal baffle 11 also aids in keeping the side wall from bowing out and stable. In this instance one end of the baffle is attached to end wall 6' and the other end is attached to end wall 6. Similarly, a baffle may be found running along the length of the end walls as well. These horizontal baffles may also be an extension of the playing surface. However, any suitable stabilizer to stabilize the end walls and side walls may be incorporated.

As seen in FIG. 2, when the game is deflated, the side walls and end walls are now collapsed, and are substantially in the same plane as the playing surface. With the blower detached from the game in the deflated collapsed position, the game can now be folded or rolled up and stored in a compact bag for facile transport or storage.

While the foregoing provides a detailed description of several embodiments of the invention, it is to be understood that this description is illustrative only of the principles of the invention and not limitative. Furthermore, as many changes can be made to the invention without departing from the scope of the invention, it is intended that all material contained herein be interpreted as illustrative of the invention and not in a limiting sense.

The embodiments of the invention in which an exclusive property or privilege is claimed are as follows:

1. An inflatable portable substantially collapsible structure comprising:

an inflatable substantially collapsible playing field having at least two walls, a top and a bottom, said field being of a form selected from the group consisting of a hockey rink, a soccer field and a baseball field, at least one object director to direct an object with a fluid along or above the playing surface and at least one score area.

2. The structure of claim 1 further comprising a fluid supply to provide fluid to the inflatable structure and to the at least one object director.

3. The structure of claim 2 further comprising an aperture at a predetermined position on said playing field for attachment of said fluid supply.

4. The structure of claim 3 wherein said fluid is air.

5. The structure of claim 3 wherein said fluid is water.

6. The inflatable structure of claim 1 further comprising at least one obstacle proximate said playing field.

7. The structure of claim 6 where said obstacle is inflatable.

8. The inflatable structure of claim 1 further comprising a score indicator.

9. An inflatable game structure comprising:

an inflatable playing field having at least two sides, a top and a bottom, at least one fluid supply element to direct an object, at least one score area, and at least one inflatable obstacle at a predetermined location proximate said top, said obstacle being substantially in the shape of a player.

10. The structure of claim 9 wherein said top and bottom are connected by a plurality of substantially vertical baffles.

11. The structure of claim 9 wherein said structure further comprises a fluid supply.

12. The structure of claim 11 wherein said structure further comprises an aperture for connection of said fluid supply.

13. The structure of claim 9 wherein said top further comprises game indicia thereon.

14. The structure of claim 9 wherein said at least one fluid supply element is an air hose.

15. The structure of claim 14 further comprising a plurality of air hoses.

16. The structure of claim 9 further comprising at least two goal areas each proximate said end walls wherein each of said at least two goal areas further comprise a goal keeper and wherein said goal keeper is a substantially movable foam baton.

17. The structure of claim 9 wherein said object is of substantially foam material.

18. The structure of claim 9 further comprising a score board.

19. An inflatable game structure comprises two side walls, two end walls, a top and a bottom;

a plurality of substantially movable air hoses, integral with said side walls, providing a stream of air along said top;

a playing piece movable along or above said top, by said stream of air;

a plurality of substantially inflatable obstacles, substantially in the shape of players of the game at predetermined positions proximate said top;

at least two score areas, each score area proximate each of said two end walls, a goal keeper proximate each of said two score areas.

20. A game for amusement and promotion of physical activity comprising the use of an inflatable portable playing field comprising:

an inflatable unit substantially collapsible and portable when not in use having a top, a bottom and at least two sides said top further comprises a playing field a plurality of fluid nozzles to direct an object along or above the playing field, at least two score areas, wherein said game comprises at least one object movable to said at least two score areas, at least two players moving said game piece to said at least two score areas with at least one of said plurality of fluid nozzles and wherein each of said score areas further comprise a goal keeper, wherein said goal keeper is a substantially elongated baton, and wherein said baton is of substantially foam material.

* * * * *